United States Patent [19]

Miyatsuka et al.

[11] 3,944,682

[45] Mar. 16, 1976

[54] METHOD OF PROVIDING AN ELECTROPHOTOGRAPHIC COATING AND COMPOSITIONS FOR THE METHOD

[75] Inventors: Hajime Miyatsuka; Satoru Honjo; Kenichi Sawada; Takashi Saida, all of Asaka, Japan

[73] Assignee: Rank Xerox, Ltd., London, England

[22] Filed: Nov. 14, 1973

[21] Appl. No.: 415,597

[30] Foreign Application Priority Data

Dec. 28, 1972 Japan ..... 47-482421

[52] U.S. Cl. ..... 427/74; 427/126; 427/121; 427/385; 427/372; 427/391; 96/1 R

[51] Int. Cl.[2] ..... B05D 5/12

[58] Field of Search ..... 96/1 R, 1.5; 117/201, 232, 117/100 M, 132 A, 132 B, 132 BE, 132 C, 132 CB, 161 UT, 161 UZ, 161 ZB, 155 UA; 252/501, 518; 427/74, 126, 121, 385, 372, 391

[56] References Cited

UNITED STATES PATENTS 3,121,006 6/1957 Middleton et al. ..... 96/1.5

3,595,650 7/1971 Holyinger et al. ..... 96/1.5

3,598,643 8/1971 Hodes et al. ..... 96/1.5

*Primary Examiner*—Cameron K. Weiffenbach

*Assistant Examiner*—Charles R. Wolfe, Jr.

*Attorney, Agent, or Firm*—James J. Ralabate; James P. O'Sullivan; Ronald L. Lyons

[57] ABSTRACT

A method of forming an electrophotographic coating which includes preparing a mixture which comprises finely divided photoconductive material dispersed in an organic resin binder. The resin, which exhibits an acid value of at least 3, or a hydroxyl value of at least 15, is heat-treated for a time and temperature enclosed within the area ABCDEFGH of the temperature-treating diagram shown in the accompanying drawing. Following this treatment, the mixture is dissolved in a volatile solvent for the binder resin, and the dispersion is coated onto a conductive backing to form a substantially uniform layer.

4 Claims, 1 Drawing Figure

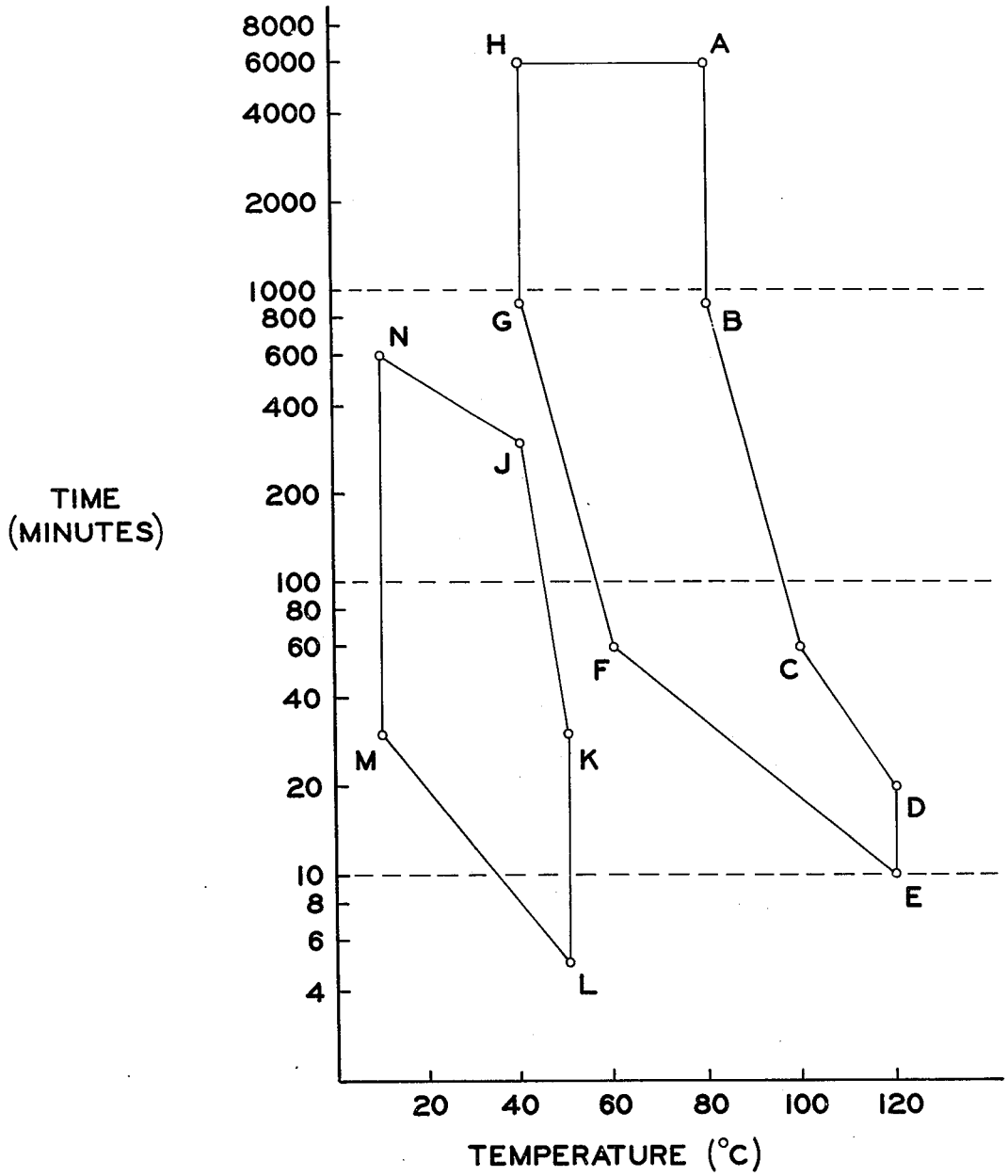
8000
6000
4000
2000
1000
800
600
400
200
100
80
60
40
20
10
8
6
4
TIME
(MINUTES)
H
A
G
B
N
J
F
C
M
K
D
E
L
20
40
60
80
100
120
TEMPERATURE (°C)

METHOD OF PROVIDING AN ELECTROPHOTOGRAPHIC COATING AND COMPOSITIONS FOR THE METHOD

BACKGROUND OF THE INVENTION

This invention relates to a method of providing a pigment/binder type electrophotographic coating and compositions for such a method.

Pigment/binder type electrophotographic coatings generally refer to those comprising a photoconductive pigment dispersed in a binder such as an insulating resinous material. Such coatings are described in detail, for example, in U.S. Pat. No. 3,121,006. These coatings can be prepared by coating on a conductive backing a mixture comprising a photoconductive powder, a binder resin and solvent for said resin, followed by drying the coated mixture to evaporate the solvent. When the coating thickness is about 10 microns, the drying is completed in about 2 hours at room temperature. However, in order to insure a coating having satisfactory electrophotographic charge retaining properties, drying at an elevated temperature is recommended.

In the case of electrophotographic paper, such as Electrofax, which is used in document copying, and which is manufactured by paper manufacturers under controlled conditions, enforced drying may be carried out by the manufacturer without any difficulty. However, in the case of electrophotographic marking, utilizing electrophotographic marking paints, the end users of the paint must carry out coating and drying thereof on the material to be marked. Thus, enforced drying imposes upon the user an additional processing as well as an additional cost for suitable heating apparatus. Effective heating of materials to be marked is also a problem in that the materials are generally large in size, having enormous heat capacities, which also increases the cost of the marking operation. If heating is carried out by burning relatively low-cost crude petroleum, sulfur oxide compounds originating from impurities in the petroleum severely deteriorate the electrophotographic properties of the electrophotographic coating. Moreover, the installation of heating apparatus increases the potential of an explosion or fire during operation, since the electrophotographic marking operating requires various kinds of organic coating solvents, fixing agents, or in some cases, carrier liquid for development.

OBJECTS OF THE INVENTION

An object of the present invention is to provide a manufacturing method for an electrophotographic coating material which exhibits superior electrophotographic properties without enforced drying after coating.

Another object is to provide electrophotographic coating compositions and coating mixtures which require no drying process at elevated temperatures after coating.

BRIEF DESCRIPTION OF THE DRAWINGS

The drawing illustrates the temperature treating period for the heat treatment and drying period of the present invention.

SUMMARY OF THE INVENTION

It has been found that electrophotographic coatings made from mixtures comprising a binder resin containing polar groups and a suitable photoconductive material, such as zinc oxide, which have been heat-treated under certain conditions prior to coating, exhibit satisfactory charge acceptance after drying at room temperature.

The binder resin of the present invention must have a suitable range of acid value or hydroxyl value and the heat-treatment must fall within a certain temperature range. It has been found that the binder resin must possess an acid value not less than 3, or a hydroxyl value not less than 15, and that the dispersion comprising such resin and a photoconductive powder should be heat-treated in a condition included in the range enclosed by ABCDEFGH on the temperature-treating period diagram shown in the accompanying drawing.

According to the present invention, the heat-treated mixture is again redissolved in a volatile solvent, which can dissolve the binder resin, and the resulting dispersion is then coated on a conductive backing and then dried under a condition included in the range enclosed by JKLMN of the drawing.

In addition to the above described conditions, the resin binder used in the present invention must satisfy the conventional requirements for a binder for a pigment/binder type electrophotographic coating. The resin may be either thermoplastic or thermosetting. In the latter case, possible curing of the resin must be carefully avoided during the heat-treatment by controlling the temperature or period of heating or by adding an anti-oxidant to the mixture. Suitable resins include alkyd, alkyd modified with styrene, acrylic, or phenol-formaldehyde resin, epoxyester resin, vinyl polymers comprising vinyl acetate, acrylate, methacrylate, styrene, or vinyl chloride and butadiene-containing copolymers. A group of suitable vinyl polymers are described in Japanese Patent Publication 69-6394, however, the limitations on the molecular weight described therein is not critical, and polymers of wider molecular weight can be successfully used in the present invention. In addition, polymers containing hydroxylalkyl acrylate or methacrylate, or glycidyl acrylate or methacrylate as described in Japanese Patent Publication 69-17316 and German Offenlegungschrift No. 1,522,562 are also suitable for use in the present invention. When vinyl chloride-vinyl acetate copolymers are used, those containing 80 to 50 percent by weight of vinyl chloride are preferred. They may contain, as minor ingredient, maleic anhydride, maleic acid or vinyl alcohol unit. The above mentioned resins may be used solely or in combination. Suitable examples of these materials may be found in British Patent No. 1,141,282.

In the present invention, the binder resin may comprise one or more ingredients, thus those resins which do not satisfy the requirement on acid or hydroxyl value by themselves may be employed in combination with complementary partners. For example, low acid value resins may be mixed with those with high acid values. Polymer combinations may be selected considering still other factors affecting electrophotographic properties. For example, polysiloxane resins may be introduced in the formulation to improve insulating properties at relatively high humidities. If the acid or hydroxyl value of the binder resin used is too low, no improvement of charging property takes place by heat treatment under the conditions described above, or even under more intense conditions. Therefore, it is essential that the binder resin possesses an acid value not less than 3 or a hydroxyl value not less than 15. When the resin possesses a too high acid or hydroxyl value, poor electrophotographic properties sometimes occur, especially under high humid conditions. The preferable range for resins useful in the present invention are from 5 to 40 for acid value and from 20 to 150 for hydroxyl value.

Various photoconductive materials which are well known in the art may be used with the binder material to form a coating mixture. These materials include the oxides and sulfides of zinc, cadmium, titanium arsenic or lead. Among these, zinc oxide and titanium dioxide are especially preferred in that they exhibit a white or off-white coating. With a relatively high sensitivity, zinc oxide often surpasses titanium dioxide.

The blending or mixing of the binder resin and the photoconductive powder may be carried out by any conventional technique. Suitable techniques include the use of a ball mill, attritor, sand mill, roll mill or kneader. In some cases, this mixing procedure may be rather mild, and in place of the intense mixers described above, a simple stirrer may be employed.

No special limitation exists on the ratio of the binder resin to photoconductive powder. As in conventional electrophotographic members which contain a pigment/binder coating, too much binder tends to produce a developed image with high background, while with too little binder, the charge retention property deteriorates. The mixing ratio depends on the chemical composition of the binder, the photoconductor and other additives used. When the photoconductor is zinc oxide, the preferred range of the photoconductor/binder ratio lies between 3:1 and 10:1 by weight, with a more preferable ratio being from 5:1 to 8:1. Optionally, additives such as spectral sensitizers may also be used. No special requirement is imposed on the solvent used in the mixing operation. The amount of the solvent is preferably kept at a minimum in order to effectively and economically carry out the subsequent heat-treatment. For this point of view, mixing with a roll mill and kneader are especially suitable.

Mixtures comprising the binder resin and the photoconductive powder thus prepared are then subjected to heat-treatment in accordance with the present invention. It is desirable, prior to the heat-treatment, to remove the solvent from the mixture in order to promote the efficiency of the heat-treatment. This may be done, for example, by centrifuge. The mixture resulting from solvent removal may be pulverized or made into fine beads by any type of bead forming apparatus. The mixture containing the solvent may also be directly converted into powder through spray drying. Such a preliminary operation is effective to shorten the heat-treating period.

The heat-treating conditions are essentially important in the present invention in that improper selection of these conditions fails to achieve the objects of the present invention. Although the temperature of the treatment depends on the binder, the heating period, and the physical configuration of the mixture to be treated, it has been found that temperatures of at least about 40°C are always necessary, with temperatures of about 60°C or higher being preferred.

In general, with high temperatures at relatively longer time periods, and small particle diameters of the mixture, the charging property of the finally obtained electrophotographic coating is improved to a greater extent. However, treatment at too high a temperature results in difficulty of redispersion of the product due to aggregation, and also can cause the formation of hard cake as the result of softening of the resin above its softening point. In addition, thermally unstable additives such as spectral sensitizers tend to decompose, and the charging properties often begin to deteriorate when excessive heating is employed. It has been determined that the upper limit of the heat-treating temperature is about 120°C, and more preferably about 100°C or less.

The time period for heating varies with the heat-treating temperature. Generally speaking, this relationship is qualitatively reciprocal. To more clearly define this relationship, numerous experiments were carried out with the following results. Below 60°C far longer treating periods are required compared with about 60°C. Thus, to realize a certain improvement, the lower limit of the heating period is about 1 hour at 60°C, about 4 hours at 50°C and about 15 hours at 40°C. At higher temperatures, the time reduces to about half an hour at about 80° to 100°C. At the upper temperature limit, avoiding the above-mentioned adverse effects, treatments up to 11 hour at 100°C, and about 20 minutes at 120°C are permitted. At temperatures higher than 120°C, the control of the treating period becomes difficult since the difference between the upper and lower limits becomes very small. Below 80°C, prolonged treatment did not prove adverse, and thus the upper limit of the treating time period may be determined mainly from the practical or industrial point of view. These experiments determined the range of the heat-treatment conditions set forth in the diagram of the drawing.

The heat-treatment of a mixture comprising a binder resin and a photoconductor in accordance with the present invention is preferably carried out under temperature and time conditions enclosed by the area ABCDEFGH on the temperature-treating period diagram shown in the drawing. The coordinates for each point from A to H are tabulated in Table 1 below, in which fluctuation of ± 5°C and ± 10 percent are allowed for the temperature and time period, respectively.

TABLE I

| | Temperature (°C) | Period (Minutes) |
|---|---|---|
| A | 80 | 6,000 |
| B | 80 | 900 |
| C | 100 | 60 |
| D | 120 | 20 |
| E | 120 | 10 |
| F | 60 | 60 |
| G | 40 | 900 |
| H | 40 | 6,000 |

The heat-treatment may be carried out in various ways. One method includes using hot air and including passing a hot air stream to the treated material. During the treatment the material may be kept stationary or be perturbed or agitated by a stirrer. Other techniques such as floating bed heating, jet stream heating, gas stream heating, vacuum heating or spray drying may also be employed.

Redispersion of the heat-treated mixture may be easily accomplished by mild stirring with a dispersing solvent, provided that the preliminary blending is sufficiently satisfactory, and that the heat-treatment is appropriate. The dispersing solvent should be volatile and able to dissolve the binder resin. If the solubility of the resin in the solvent used is low, one fails to obtain a stable dispersion and the resulting coating does not show suerior electrophotographic properties. As a general empirical rule, coating dispersions with higher dispersion stability, result in improved electrophotographic properties. When the redispersion requires an intense mechanical work, for example, by a slightly excessive heat-treatmen., powerful dispersing apparatus may be employed such as a ball mill, attritor, or sand mill, which results in providing stable, fine dispersions.

The coating mixtures thus prepared may be coated on any suitable conductive backing to form an electrophotographic coating. Almost any known coating method may be adopted for use in the present invention. These include spray coating, for example, when the materials to be coated is a rigid metal plate. Any suitable metal substrate such as iron, steel, aluminum or brass may be used. Other suitable substrates include wood, plastics or cellulose fiber products which have been surfacetreated with conductivity imparting agents.

As already described above, the drying conditions are limited by the temperature and time period. Suitable and practically feasible drying ranges are enclosed by the area JKLMN on the diagram. The coordinates are shown in Table II below.

In many cases, drying is completed when a substantial amount of the dispersing solvent has been removed from the coating surface. Thus the coated material may be left in the air without any air stream passing or heating.

TABLE II*

| | Temperature (°C) | Period (Minutes) |
|---|---|---|
| J | 40 | 300 |
| K | 50 | 30 |
| L | 50 | 5 |
| M | 10 | 30 |
| N | 10 | 600 |

*Here, fluctuations are permitted ± 5°C for temperature and ±10 percent for the time period, respectively.

The dried coating according to the present invention exhibits an excellent charge accepting and retaining property after coating, followed by drying at relatively low temperatures such as 20° to 30°C in a short period of time up to about 2 hours. This feature of the invention, makes it particularly suitable for industrial marking whereby the imaging process is desirably effected soon after coating. The present invention eliminates the need for special drying apparatus in the marking process and reduces the economical charge of the user including running cost. Elimination of the heating source, moreover, remarkably reduces the possibility of explosion or fire hazard in the presence of inflammable solvents which are often needed for electrophotographic marking operations.

Another advantage of the present invention is that it may be expanded to allow a greater range of binder formulations which may be dried at room temperature. Conventionally, thermosetting resins when used for such formulations, necessarily suffered from the problem that these coating mixtures tended to cause a problem in some fields of electrophotographic marking where the coating is required to be stripped after marking and processing. If welding is carried out on the material bearing an electrophotographic coating, the welded portion often inlcudes blow holes. When the marked material is embedded in concrete, the presence of the coating will deteriorate the adhesion of the concrete and the coated substrate. These problems are solved utilizing the present invention which make various thermoplastic resins applicable for the marking processes which permit only room temperature drying.

The coating mixtures of the present invention can be supplied to the user not only in the form of paint, but in the form of pellets or coarse powder comprising a heat-treated mixture of resin binder and photoconductor. The use may disperse or dilute the pellet in a solvent prior to coating, and can select the solvent based primarily upon the evaporation rate. Therefore, rapid drying solvents such as methanol or ethanol may be utilized, enabling very short operating times. The general criterion for the selection of solvent is the vapor pressure at the drying temperature to be used and should be not lower than 10 mm Hg. For example, for at a drying temperature of 25°C those solvents which have greater evaporating rates than n-Bu acetate, toluol and EtOH may be recommended, while at 40°C, solvents more volatile than amyl acetate may be used. Since the practical range of temperature is about 10° to 35°C in usual operating areas, xylol is the slowest solvent.

A certain class of resin were found to be soluble only in slowly evaporating solvent systems containing BuOH, iso-PrOH, Cellosolve, or Cellosolve acetate, and were able to give stable dispersions only when these solvents were employed. Coating mixtures containing such solvents require long drying periods only after which desirable electrophotographic properties develop. The application of the present invention avoids these problems.

The net effect of the heat-treatment of the present invention to cause a chemical interaction between the resin and the photoconductor surface which improves the charge accepting and retaining properties of the finally obtained coating. In fact, if one anaylzes the content of the residual solvent in the two coatings obtained from the same formulations with and without heat-treatment, in many instances no difference is detected, and yet the charge accepting and retaining properties are quite different.

DESCRIPTION OF THE PREFERRED EMBODIMENT

The following examples further specifically define the present invention with respect to a method of manufacturing and testing improved electrophotographic coating materials. Unless otherwise mentioned, parts and percentages in the examples are expressed by weight.

EXAMPLE I

The following ingredients are blended by passing through a three-roll mill twice at 20°C to give a paste A.

| | |
|---|---|
| ZnO (Sazex 2,000 from | 800 parts |

-continued

| | |
|---|---|
| Sakai Kagaku Ltd.) | |
| resin varnish* | 200 parts |
| toluol | 250 parts |

*A varnish containing 50 percent of the following copolymer; styrene 38 parts, butylacrylate 50 parts, 2-hydroxyethyl methacrylate 10 parts, and acrylic acid 2 parts. The solvent consisted of toluol and BuOH (2:1 in volume ratio). The acid value of the resin was 13, and hydroxyl value 20.

The resulting mixture containing the ZnO in a very finely dispersed state, exhibits a Hegmann Scale 7.0 at by measurement with the grind gauge.

After removal of the solvent by keeping the paste A at 40°C for 5 hours, the dried product is broken into pieces of about 1 $cm^3$. The paste is then subjected to heat-treatment under the conditions shown in Table III. One hundred parts of the paste are charged in a ball mill together with 100 parts of solvent (toluol:MeOH mixtue in a 7:3 volume ratio) and ground for 10 hours at 20°C. The resulting coating dispersion is coated with a coating rod onto an aluminized (by vacuum deposition) polyethylene terephthalate film to give a dried thickness of 8 microns. The coating is then dried for 2 hours at 20°C. The film is cut into 19 pieces designate samples 1–19, respectively.

For comparison, 100 parts of the paste A is diluted with 40 parts of toluene and coated on the same aluminized film in a similar mananer to give a dried thickness of about 8 microns. Then the film is cut into 12 pieces (samples 20–31, respectively), each of which was dried but not heat-treated under a condition shown in Table III.

The charge accepting property of each sample is measured by charging the coating with −6KV corona discharge. The measured items are initial acceptance potential $V_o$ and the residual potential after 60 seconds dark storage $V_{60}$, from which the residual ratio was obtained by the formula:

$$V_{60}/V_0 \times 100\ (\%)$$

These values are also listed in Table III.

While sample 8, which was treated at 40°C for 2 hours, exhibits satisfactory charge acceptance, samples 1–7 show poor performance as the result of more mild treating conditions. On the other hand, samples 9–19 which were subjected to more intense treatment exhibit comparable levels of acceptance potential to those obtained by enforced drying after coating. Samples 20–31, which were not heat-treated, show poor electrical properties in the low drying temperature range. Only with undesirable high drying temperatures could the electrical properties be raised to an acceptable level.

TABLE III

| Sample No. | Heat-treatment Condition Temp. | Period | Drying Temp. | Condition Period | Initial Acceptance Potential | Residual Ratio |
|---|---|---|---|---|---|---|
| 1 | 20°C | 2 hr. | 20°C | 2 hr. | −5 volts | 0% |
| 2 | 20 | 4 | 20 | 2 | 7 | 0 |
| 3 | 20 | 8 | 20 | 2 | 8 | 0 |
| 4 | 20 | 20 | 20 | 2 | 28 | 30 |
| 5 | 40 | 2 | 20 | 2 | 40 | 15 |
| 6 | 40 | 4 | 20 | 2 | 65 | 22 |
| 7 | 40 | 8 | 20 | 2 | 135 | 40 |
| 8 | 40 | 20 | 20 | 2 | 180 | 77 |
| 9 | 60 | 2 | 20 | 2 | 140 | 76 |
| 10 | 60 | 4 | 20 | 2 | 170 | 71 |
| 11 | 60 | 8 | 20 | 2 | 210 | 73 |
| 12 | 60 | 20 | 20 | 2 | 210 | 78 |
| 13 | 80 | 2 | 20 | 2 | 220 | 83 |
| 14 | 80 | 4 | 20 | 2 | 200 | 86 |
| 15 | 80 | 8 | 20 | 2 | 235 | 81 |
| 16 | 80 | 16 | 20 | 2 | 220 | 82 |
| 17 | 120 | 1/6 | 20 | 2 | 210 | 90 |
| 18 | 120 | 1/4 | 20 | 2 | 200 | 88 |
| 19 | 120 | 1/3 | 20 | 2 | 220 | 93 |
| 20 | — | — | 20 | 2 | 8 | 0 |
| 21 | — | — | 20 | 4 | 15 | 70 |
| 22 | — | — | 20 | 8 | 60 | 52 |
| 23 | — | — | 20 | 20 | 80 | 55 |
| 24 | — | — | 40 | 2 | 95 | 67 |
| 25 | — | — | 40 | 4 | 150 | 67 |
| 26 | — | — | 40 | 8 | 180 | 75 |
| 27 | — | — | 40 | 20 | 240 | 85 |
| 28 | — | — | 60 | 2 | 160 | 93 |
| 29 | — | — | 60 | 4 | 220 | 91 |
| 30 | — | — | 60 | 8 | 220 | 91 |
| 31 | — | — | 60 | 20 | 235 | 95 |

EXAMPLE II

The following ingredients are blended by means of ball mill at 25°C for 6 hours.

| | |
|---|---|
| ZnO (Sazex 3,000 manufactured by Sakai Kagaku Ltd.) | 500 parts |
| resin varnish* | 200 parts |
| toluol | 330 parts |

*A varnish containing 50 percent of the following copolymer; styrene 40 parts, butylmethacrylate 40 parts, 2-hydroxyethyl methacrylate 10 parts, and maleic anhydride 2 parts. The solvent comprises toluol. The acid and hydride values of the resin are 14 and 21, respectively.

After removal of the solvent, the resulting mixture was heat-treated in a hot air stream dryer at 80°C or 5 hours. The heat-treated product is again dispersed in toluol by ball milling for 10 hours. The coating dispersion thus prepared is coated on the same polyethylene terephthalate film as in Example I. The initial acceptance potential and potential residual ratio after 1 hour drying at 25°C were −330 volts and 83 percent, respectively.

For comparison, the preliminary ball-milled mixture is coated on PET film, without heat-treatment, and left at 25°C for 1 hour, and exhibits corresponding values of −130 volts and 18 percent for acceptance potential aand potential residual ratio, respectively. When this coating is dried at 50°C for 16 hours, these values are improved to −281 volts and 88 percent, respectively.

EXAMPLE III

The coating dispersion prepared according to the invention in Example II is coated on a shot-blasted steel plate (10 mm thick) by spray coating. The plate is left at 23°C for 1 hour when the charging property is measured. The initial acceptance potential is −270 volts, and the residual ratio 84 percent.

EXAMPLE IV

The following ingredients are blended by passing twice a three roll blender at 20°C.

| | |
|---|---|
| ZnO (Sazex 2,000) | 500 parts |
| 50% varnish of styrenated alkyd resin having acid value 5, and hydroxyl value 50 | 200 parts |
| Bu acetate | 200 parts |

The resulting paste is heat-treated at 80°C for 4 hours. The product is dispersed in ethyl acetate by ball milling for 10 hours. This mixture is coated on the polyethylene terephthalate film as in Example I, and the film held at 20°C for 1 hour. The initial acceptance potential is −270 volts, and the residual ratio 89 percent.

For the purpose of comparison, the paste obtained by the first blending with the three-roll blender was coated on the same substrate upon dilution with ethyl acetate. After 1 hour storage at 20°C, the coating exhibited an initial acceptance potential of 80 volts, and a residual ratio of 11 percent.

EXAMPLE V

The procedures in Example IV were repeated except that the ZnO was replaced by $TiO_2$ manufactured by Ishihara Sangyo Ltd. under the tradename R830 (rutile form). The initial potential was −170 volts, and the residual ratio 77 percent.

EXAMPLE VI

The following ingredients were passed through a three-roll blender twice at 20°C.

| | |
|---|---|
| ZnO (Sazex 2,000) | 800 parts |
| 50% varnish of an acrylate modified alkyd resin with acid value 16, and hydroxyl value 25 | 200 parts |
| toluol | 250 parts |
| anti-oxidant (Sumilizer BHT manufactured by Sumitomo Kagaku Ltd.) | 1 part |

The resulting paste was heat-treated at 60°C for 2 hours, and then again ball milled with solvent (toluol/MeOH 7:3 by volume mixture) for 10 hours. The coating mixture thus obtained was coated on polyethylene terephthalate film similarly to the foregoing examples. The coated film was held at 20°C for 2 hours. The measurement at that point gave an initial acceptance potential of −220 volts and a residual ratio of 83 percent.

The mixture which was not heat-treated exhibited corresponding values of −100 volts and 65 percent.

Although specific components and proportions have been stated in the above description of the preferred embodiments of this invention, other suitable materials and procedures such as those listed above, may be used with similar results. In addition, other materials and changes may be utilized which synergize, enhance, or otherwise modify the photoreceptor and method of use.

Other modifications nad ramifications of the present invention would appear to those skilled in the art upon reading the disclosure. These are also intended to be within the scope of this invention.

What is claimed is:

1. A method of forming an electrophotographic article comprising: preparing a mixture which comprises finely divided photoconductive material dispersed in an organic resin binder, said resin having an acid value from about 5 to 40, or a hydroxyl value from about 20 to 150, heat-treating said mixture for a time and temperature enclosed within the areas ABCDEFGH of the temperature-treating diagram shown in the accompanying drawing, followed by dispersing said mixture into a volatile solvent for said binder resin, coating said dispersion on a conductive backing to form a substantially uniform layer, and drying said layer under the conditions enclosed within the areas JKLMN of the drawing.

2. The method of claim 1 in which the heat-treating temperature range is from about 40°–120°C.

3. The method of claim 1 wherein the photoconductive material is selected from the group consisting of zinc oxide and titanium dioxide.

4. An electrophotographic article produced by the method of preparing a mixture which comprises finely divided photoconductive material dispersed in an organic resin binder, said resin having an acid value from about 5 to 40, or a hydroxyl value from about 20 to 150, heat-treating said mixture for a time and temperature enclosed within the area ABCDEFGH of the temperature treating diagram shown in the accompanying drawing, followed by dispersing said mixture into a volatile solvent for said binder resin, coating said dispersion on a conductive backing to form a substantially uniform layer, and drying said layer under the conditions enclosed within the areas JKLMN of the drawing.

* * * * *

UNITED STATES PATENT AND TRADEMARK OFFICE

CERTIFICATE OF CORRECTION

PATENT NO. : 3,944,682

DATED : March 16, 1976

INVENTOR(S) : Hajime Miyatsuka et al

It is certified that error appears in the above-identified patent and that said Letters Patent are hereby corrected as shown below:

Column 4, line 28, delete "11 hour" and insert --1 hour--.

Column 5, line 9, delete "suerior" and insert --superior--.

Column 5, line 27, delete "surfacetreated" and insert --surface-treated--.

Column 6, line 46, delete "anaylzes" and insert --analyzes--.

Column 7, line 57, delete "mananer" and insert --manner--.

Column 9, line 3, delete "aand" and insert --and--.

Column 10, line 23, delete "nad" and insert --and--.

Signed and Sealed this

Twentieth Day of July 1976

[SEAL]

*Attest:*

RUTH C. MASON
*Attesting Officer*

C. MARSHALL DANN
*Commissioner of Patents and Trademarks*